US005392056A

United States Patent [19]

DeTeso

[11] Patent Number: 5,392,056

[45] Date of Patent: Feb. 21, 1995

[54] PROTECTIVE SHEATH FOR BROADCAST ANTENNAS

[76] Inventor: John S. DeTeso, 1902 First St., LaMarque, Tex. 77568

[21] Appl. No.: 941,906

[22] Filed: Sep. 8, 1992

[51] Int. Cl.[6] ..... H01Q 1/40

[52] U.S. Cl. ..... 343/873; 343/872

[58] Field of Search ..... 343/872, 873, 715, 901, 343/902, 704, 709, 720; H01Q 1/40, 1/42; 29/600

[56] References Cited

U.S. PATENT DOCUMENTS

| | | | |
|---|---|---|---|
| 2,568,710 | 9/1951 | Bolljahn | 343/872 |
| 2,627,026 | 1/1953 | Kandoian et al. | 343/793 |
| 2,681,412 | 6/1954 | Webster | 343/873 |
| 4,377,812 | 3/1983 | Göbel et al. | 343/872 |
| 4,500,888 | 2/1985 | Brandigampola | 343/900 |
| 4,623,895 | 11/1986 | Bowering | 343/873 |
| 4,725,395 | 2/1988 | Gasparaitis et al. | 343/873 |

FOREIGN PATENT DOCUMENTS

| | | | |
|---|---|---|---|
| 1115291 | 4/1956 | France | 343/872 |
| 2631489 | 11/1989 | France | H01Q 1/40 |

*Primary Examiner*—Donald Hajec
*Assistant Examiner*—Tan Ho
*Attorney, Agent, or Firm*—Harrison & Egbert

[57] ABSTRACT

A polymeric sheath for a broadcast antenna having a tubular length of a flexible polymeric material with one closed end and one open end. The tubular length has a diameter suitable for extending around the antenna. The tubular length of flexible polymer is liquid tight. A sealing member is provided adjacent the open end of the tubular length so as to form a liquid-tight environment within the tubular length. The length of polymeric material tapers from the open end toward the closed end. The sealing member is a clamp which extends around the exterior of the open end so as to place the open end in liquid-tight juxtaposition with the antenna. The flexible polymeric material may be polyethylene or neoprene. The polymeric sheath has a length of between four and twenty-four feet.

16 Claims, 1 Drawing Sheet

PROTECTIVE SHEATH FOR BROADCAST ANTENNAS

TECHNICAL FIELD

The present invention relates to broadcast antennas, in general. More particularly, the present invention relates to methods and apparatus for protecting such broadcast antennas from deterioration.

BACKGROUND ART

Broadcast antennas, and related antennas, are commonly used for the transmission of radio signals. Broadcast antennas exist throughout the United States and serve virtually all locations in the United States. Broadcast antennas are used for television transmissions, radio transmissions, cellular telephone transmissions, and a wide variety of other types of transmissions. Typical broadcast antennas have a layer of insulating material extending around an inner conductor. The inner conductor broadcasts the signals so that the signals pass through the insulating material. Typically, the insulating material is fiberglass or similar material.

Throughout the years, the insulating material around the inner conductors will deteriorate by exposure to the elements. Additionally, as the antenna begins to deteriorate, increased power must be applied to the antenna for suitable broadcast. The increase of power to the antenna can result in further deterioration of the insulating material. When the insulating material starts to deteriorate, cracks and other voids will form.

In addition to the deterioration caused by increased power to the antenna, various other factors accelerate the deterioration of the broadcast antenna. For example, many antennas deteriorate and experience degradation of materials by virtue of long-term exposure to ultraviolet radiation, to the corrosive atmospheres of industrial areas, to acid rain, etc. These factors eventually deteriorate the antenna to the extent that replacement is necessary. Whenever replacement is required, a very great expense is experienced by the broadcaster. Many times, small cracks in the material are not sufficiently harmful so as to justify replacement of the antenna. Ideally, broadcasters would be pleased to avoid the expense of antenna replacement for as long as possible.

In the past, various patents have issued for protective coatings relating to antennas. U.S. Pat. No. 3,789,418, issued on Jan. 29, 1974, describes a laminated antenna. The antenna lamination consists of two longitudinally staggered groups of transversely cambered steel strips. These steel strips are disposed in a mirror-inverted arrangement so as to form a biconvex cross section. This covering is intended to provide protection against atmospheric influences, contamination and injuries, and prevents reflections of light. U.S. Pat. No. 3,899,787, issued on Aug. 12, 1975, describes an antenna system in which a coaxial sleeve, approximately a quarter wavelength long, is mounted exteriorly of and is associated with each tubular radiating element inside of the radome for broadbanding the feed-point impedance of the dipole antenna. U.S. Pat. No. 4,377,812, issued on Mar. 22, 1983, to Gobel et al describes a tower or cupola-like covering for the protection of radio or television antennae against weather. This covering is formed from sectional casing in which each section of the casing is attached along its bottom or top edge to a supporting structure. Expansion joints are formed between such edges so as to transmit no supporting forces. This construction eliminates compression or tension forces in the covering which cause damage to such a covering.

It is an object of the present invention to provide a protective covering for broadcast antennas. More particularly, it is an object of the present invention to provide a protective covering that is easy to apply, easy to manufacture, and relatively inexpensive.

It is a further object of the present invention to provide a protective sheath for an antenna which serves to temporarily avoid the expense of antenna replacement.

These and other objects and advantages of the present invention will become apparent from a reading of the attached specification and appended claims.

SUMMARY OF THE INVENTION

The present invention is a protective sheath for a broadcast antenna which comprises a tubular length of a flexible polymeric material having one closed end and one open end. This tubular length has a diameter suitable for extending around the antenna. The tubular length of flexible polymeric material is of a liquid-tight material. Suitable sealing means are provided so as to seal the open end of the tubular length to the antenna.

The tubular length of polymeric material is between four and twenty-four feet long. The tubular length tapers from the open end toward the closed end.

The sealing means includes a clamp which extends around an exterior surface of the open end. The clamp is tightenable so as to place the open end in liquid-tight juxtaposition with the antenna. A valve may be provided within the tubular length between the open end and the closed end so as to enable vapors from within the tubular length to pass therethrough. The polymeric material may be either polyethylene and/or neoprene.

The present invention is also a broadcast antenna which includes an inner conductor, an insulator, and the protective polymeric sheath extending around the exterior surface of the insulator. Additionally, the present invention is a method of repairing broadcast antennas which comprises the steps of: (1) positioning a polymeric sheath in proximity to the top of the broadcast antenna; (2) extending the polymeric sheath over the exterior surface of the broadcast antenna such that the polymeric sheath extends around a diameter of the broadcast antenna; (3) draping the polymeric sheath along the broadcast antenna for a desired length of the broadcast antenna; and (4) sealing a bottom end of the polymeric sheath to the surface of the broadcast antenna.

DETAILED DESCRIPTION OF THE INVENTION

Figure 1:
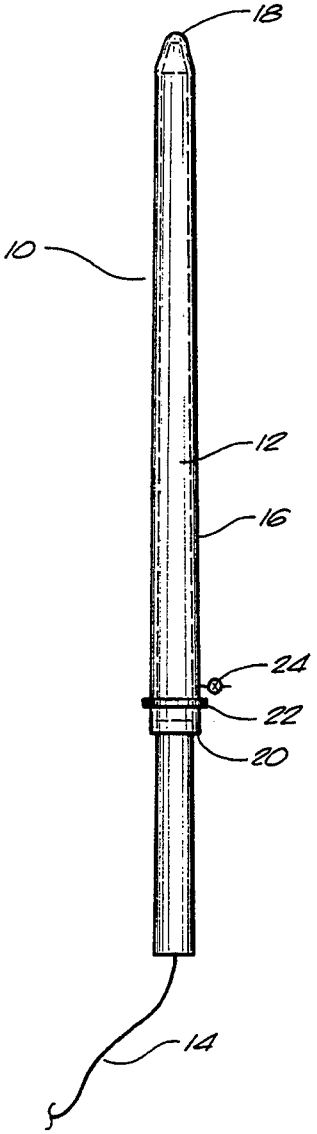
FIG. 1 is an exterior view showing the application of the protective sheath to the exterior of the broadcast antenna.

Referring to FIG. 1, there is shown at 10 the broadcast antenna in accordance with the preferred embodiment of the present invention. The broadcast antenna 10 includes an insulator 12 extending around an inner conductor 14. A protective polymeric sheath 16 extends around the insulator 12 in liquid-tight relationship with the insulator. The insulator 12 allows broadcast signals from the inner conductor 14 to pass therethrough. The insulator 12 generally serves to isolate the inner conductor from exterior elements, such as the weather.

The polymeric sheath 16 has a closed end 18 and an open end 20. As can be seen, the polymeric sheath 16 extends around the diameter of the insulator 12. As contemplated by the present invention, the sheath 16 is light weight and conforms to the shape of the antenna. The sheath is, ideally, made of a polyethylene or a neoprene material. However, within the scope of the present invention, it is possible that the sheath 16 could be made of a Teflon-coated canvas, a polymer-coated canvas, a polyplastic, or a polyfiberglass. All of these materials have certain elastic properties which allow the sheath to come into contact with and to conform to the surface of the antenna. At the same time, such materials do not interfere with incoming signals to or outgoing signals from the antenna 10.

In FIG. 1, it can be seen that a sealing member 22 extends around the open end 20 of the sheath 16. The sealing member 22 serves to place the open end 20 in liquid-tight juxtaposition with the insulator surface 12. Specifically, the sealing member 22 is a clamp which extends entirely around the open end 20. This clamp 22 is engagable so as to affix the open end 20 to the insulator.

Additionally, a valve 24 is also fastened to the sheath 16 between the closed end 18 and the open end 20. This valve allows vapor from between the interior of the sheath 16 and the exterior of the insulator 12 to pass out of this area.

The sheath 16 can be made of a suitable length so as to extend around any cracks formed through the insulation 12 of antenna 10. Typically, the sheath 16 of the present invention will have a length of between four and twenty-four feet. In order to apply the protective covering over the exterior of the antenna, the closed end 18 is placed over the top of the antenna and is draped over the exterior surface of the antenna. After the protective sheath 16 has been properly draped, the clamp 22 is tightened so as to seal the protective sheath 16 to the exterior surface of the antenna. This forms a liquid-tight area within the interior of the sheath. As a result, weather elements will not further deteriorate the antenna 10 and will not penetrate through any cracks that may have formed through the insulation 12 of antenna 10. The protective sheath 16 of the present invention serves, at least, as a temporary protective covering for the antenna 10. This essentially allows the broadcaster to avoid antenna replacement as long as possible.

Figure 2:
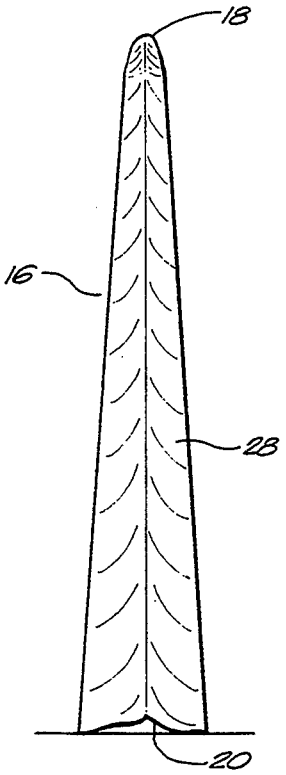
FIG. 2 is a perspective view of the isolated protective sheath.

FIG. 2 is an isolated view of the protective sheath 16. It can be seen that the protective sheath 16 has a closed end 18 and an open end 20. The protective sheath 16 tapers from the open end 20 toward the closed end 18. The length of the protective sheath 16 can be suitable so as to properly facilitate the covering of the antenna. Since the sheath 16 has elastic properties, it can effectively conform to the exterior contour of the antenna. As such, it will be effectively affixed in position on the surface of the antenna. Installation of the protective sheath 16 on an antenna is accomplished by placing the open end 20 over the top of the antenna and by draping the body 28 of sheath 16 along the exterior surface of the antenna. Eventually, the closed end 18 of sheath 16 will come into contact with the very top of the antenna.

Figure 3:
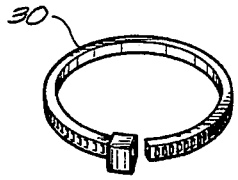
FIG. 3 is an isolated view of the clamp of the present invention.

FIG. 3 illustrates a clamp 30 that can be applied along the exterior of the sheath 16 so as to cause the open end 20 of sheath 16 to be placed in liquid-tight juxtaposition against the surface of the antenna. Clamp 30 can be a self-tightening type of clamp suitable for exerting sufficient forces so as to create a uniform seal. Alternatively, it should be kept in mind, that the sealing mechanism can also be alternative fastening devices woven into the open end 20. Additionally, a gusset could be placed at the open end 20 so as to create the necessary seal.

The sheath 16 may incorporate a suitable valve mechanism so as to release any condensation between the interior of the sheath 16 and the exterior of the antenna. Typically, such a valve would be activated by head pressure differential between the exterior atmosphere and the atmosphere interior of the sheath. The release of condensation can be effective so as to avoid the buildup of liquids within the interior of the sheath. However, in keeping with the present invention, it may also be possible to utilize a desiccant material or a dehydrator system so as to avoid condensation problems in the interior of sheath 16.

Figure 4:
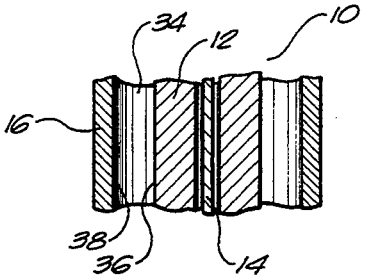
FIG. 4 is a cross-sectional view showing a portion of the protective sheath around the broadcast antenna.

FIG. 4 shows the relationship of the protective sheath 16 over the exterior insulator 12 of the antenna 10. It can be seen that the conductor 14 extends centrally through the insulator 12. A very small space 34 is formed between the exterior surface 36 of insulator 12 and the inner surface 38 of sheath 16. Space 34 will normally occur as the sheath 16 is draped over the antenna. The space 34 will vary in accordance with the tightness of the sheath 16. The use of the valve 24, or related dehydrator, is generally used so as to eliminate any moisture forming within space 34.

The sheath 16 of the present invention is very light weight and conforms to the various antenna shapes. The sheath can fit any sized and shaped antenna. The length of the sheath can be trimmed so as to correspond to the antenna length. The sheath can be secured to any antenna by the use of the suitable clamping mechanism 30.

The use of the protective sheath 16 of the present invention eliminates those problems which result from the cracking and deterioration of the insulating material on broadcast antennas. As the insulating material begins to deteriorate, the protective sheath can be applied quickly and easily to the exterior surface of the antenna so as to preserve the antenna and to avoid replacement as long as possible. If the antenna sheath 16 should deteriorate, then it can be easily removed and replaced at minimal expense. The use of the sheath 16 has a density which does not interfere with the broadcast signals. The present invention offers an inexpensive solution which avoids antenna replacement.

The foregoing disclosure and description of the invention is illustrative and explanatory thereof. Various changes in the details of the illustrated construction, or of the steps of the described method, can be made within the scope of the appended claims without departing from the spirit of the invention. The present invention should only be limited by the following claims and their legal equivalents.

I claim:

1. A protective sheath for removable placement over a broadcast antenna comprising:

a tubular length of a flexible polymeric material having one closed end and one open end, said length having a diameter suitable for extending around the antenna, said length of flexible polymer being liquid-tight; and sealing means for sealing said open end directly to a surface of the antenna, said sealing means for forming a water-tight environment within said tubular length, said sealing means comprising a clamp means extending around an exterior surface inwardly of said open end, said clamp means being tightenable for drawing a surface of said tubular length into liquid-tight juxtaposition between said clamp means and a vertical exterior surface of said antenna.

2. The sheath of claim 1, said length being between four and twenty-four feet.

3. The sheath of claim 1, said polymeric material having greater flexibility than the antenna.

4. The sheath of claim 1, said length of polymeric material tapering from said open end toward said closed end.

5. The sheath of claim 1, further comprising:

valve means fastened to said polymeric material between said open end and said closed end, said valve means for enabling vapors to pass from an interior of said tubular length.

6. The sheath of claim 1, said flexible polymeric material selected from the group consisting of: polyethylene and neoprene.

7. A broadcast antenna comprising:

an inner conductor;

an insulator extending around said inner conductor, said insulator allowing broadcast signals to pass therethrough, said insulator for isolating said inner conductor from exterior elements; and an elastic protective polymeric sheath extending around said insulator, said polymeric sheath in liquid-tight relationship with said insulator, said polymeric sheath removably positioned over said insulator, said sheath having a closed end extending over a top of said insulator, said insulator having a generally tubular configuration, said sheath having an open end extending around and secured directly to a diameter of said insulator; and a sealing means extending around said polymeric sheath adjacent said open end of said sheath, said sealing means for placing an inner surface of said sheath adjacent said open end in liquid-tight juxtaposition with an exterior surface of said insulator.

8. The antenna of claim 7, said sealing means comprising a clamp extending entirely around said open end, said clamp engagable so as to affix said open end to said insulator.

9. The antenna of claim 7, further comprising:

a valve means fastened to said sheath between said closed end and said open end, said valve means for allowing vapor to pass through said valve means from between said sheath and said insulator.

10. The antenna of claim 7, said sheath having a length of between four and twenty-four feet.

11. The antenna of claim 7, said sheath being tapered from said open end toward said closed end.

12. The antenna of claim 7, said polymeric sheath being of a material selected from the group consisting of: polyethylene and neoprene.

13. The antenna of claim 7, said polymeric sheath having a density suitable for allowing broadcast transmissions to pass therethrough.

14. A method of repairing a broadcast antenna comprising:

positioning a polymeric sheath in proximity to a top of the broadcast antenna;

extending said polymeric sheath over the exterior surface of said broadcast antenna such that said polymeric sheath extends around a diameter of said broadcast antenna;

draping said polymeric sheath along said broadcast antenna for a desired length of said broadcast antenna; and sealing a bottom end of said polymeric sheath to the exterior surface of said broadcast antenna.

15. The method of claim 14, further comprising:

valving vapor from between said exterior surface of said broadcast antenna and an inner surface of said polymeric sheath.

16. The method of claim 14, said step of sealing comprising:

positioning a clamp around said bottom end of said polymeric sheath; and tightening said clamp so as to seal said bottom end to said broadcast antenna.

* * * * *